US007124782B2

(12) United States Patent
Scorl et al.

(10) Patent No.: US 7,124,782 B2
(45) Date of Patent: Oct. 24, 2006

(54) WEAVING MACHINE INCLUDING A SELVEDGE TUCKING APPARATUS FOR WEFT THREADS

(75) Inventors: Hans-Dieter Scorl, Rüti (CH); Anton Kuehne, Hombrechtikon (CH)

(73) Assignee: Sultex AG, Rueti (CH)

( * ) Notice: Subject to any disclaimer, the term of this patent is extended or adjusted under 35 U.S.C. 154(b) by 24 days.

(21) Appl. No.: 10/931,810

(22) Filed: Aug. 31, 2004

(65) Prior Publication Data

US 2005/0061383 A1 Mar. 24, 2005

(30) Foreign Application Priority Data

Sep. 2, 2003 (EP) ..... 03405634

(51) Int. Cl.
*D03D 47/40* (2006.01)

(52) U.S. Cl. ..... 139/430

(58) Field of Classification Search ..... 139/435.5, 139/430, 434, 435.1, 435.3, 195, 54
See application file for complete search history.

(56) References Cited

U.S. PATENT DOCUMENTS 4,565,225 A * 1/1986 Bertsch ..... 139/434
4,715,410 A 12/1987 Griffith
4,909,283 A * 3/1990 Verclyte ..... 139/1 C
4,957,144 A 9/1990 Watanabe et al.
6,240,976 B1 * 6/2001 Satoh et al. ..... 139/434
6,321,796 B1 * 11/2001 Sawada ..... 139/434
6,422,270 B1 * 7/2002 Nakada et al. ..... 139/434
6,470,917 B1 * 10/2002 Yamamoto ..... 139/434
6,536,482 B1 * 3/2003 Peeters et al. ..... 139/435.5

FOREIGN PATENT DOCUMENTS

DE 0 725 262 9/1942
DE 1 710 353 7/1971
EP 0 134 377 A1 9/1983
EP 1 088 922 A1 4/2001
EP 1 314 807 A2 5/2003

* cited by examiner

*Primary Examiner*—John Calvert
*Assistant Examiner*—Andrew W. Sutton
(74) *Attorney, Agent, or Firm*—Townsend and Townsend and Crew LLP

(57) ABSTRACT

A weaving machine having an apparatus for tucking in one or more weft thread ends (2'*a*) and for forming a cloth edge (10) as well as a shed forming apparatus for forming a shed (14) with a shed apex (14*a*). The apparatus for tucking in one or more weft thread ends (2'*a*) includes an air tucker (4) which is arranged outside the cloth width (12) and at least one additional blowing nozzle (6) which is arranged within the cloth width (12), and the jet direction (6*a*) of which is oriented towards the shed apex (14*a*) in order to be able to blow the weft thread ends (2'*a*) into the shed apex.

18 Claims, 2 Drawing Sheets

WEAVING MACHINE INCLUDING A SELVEDGE TUCKING APPARATUS FOR WEFT THREADS

BACKGROUND OF THE INVENTION

The invention relates to a weaving machine, and to an apparatus and method for tucking in one or more weft thread ends and for forming a cloth edge.

In order to form a firm cloth edge, the weft threads which are inserted into a shed in a weaving machine are severed at their ends with excess length after completion of the weft insertion and the free ends are bent into the open shed after the next change of shed but before the next beating up of the weft thread. As a rule the procedure for the bending in, which is designated as tucking in of the weft thread in technical textile terminology, takes place either mechanically, pneumatically or pneumo-mechanically. An example of a mechanical selvedge tucking apparatus with a strip tucking needle is disclosed for example in the published document DE-AS 1 710 353. An example of a pneumo-mechanical embodiment is known from EP-A-0 134 377. In this pneumo-mechanical embodiment a tucking needle with an eye is used into which the thread end is threaded by means of compressed air. The disadvantage of both the mechanical and the pneumo-mechanical selvedge tucking apparatuses consists in that their use is restricted to certain maximum speeds of rotation of the weaving machine, which is caused by the mechanical processes.

In order nevertheless to enable higher speeds of rotation of the weaving machine in the manufacture of cloths with selvedges, purely pneumatic selvedge tucking apparatuses, so-called air tuckers, are used. A typical example of a pneumatic selvedge tucking apparatus of this kind, which is also designated as an air strip tucker or air tucker, can be found in the specification EP-A-1 088 922. The selvedge tucking apparatus which is described in this document includes a nozzle arrangement with a plurality of nozzles which is arranged outside the cloth width in order to blow the weft thread ends into a shed.

In the case of soft and pliable weft yarns the known tuckers from the prior art normally function in a problem-free manner. However, as soon as harder and/or stiffer yarns are used, it becomes increasingly more difficult to produce an unobjectionable cloth edge. Thus e.g. the thread ends of stiffer yarns can completely or partially jump back from the tucked in position and/or the thread ends of yarns of this kind can completely or partially penetrate through the upper or lower shed before the thread ends together with the following weft threads are beaten up and bound in. The penetration of the weft thread ends through the upper or lower shed is also designated as bleeding through. As a result of the weaving errors which are caused by the improper tucking in of the weft thread ends the cloth is classed as inferior. Problems can also arise with normally pliable yarns when a plurality of weft thread ends, e.g. two, are tucked into the same shed. In this case, frequently one weft thread end is properly tucked in whereas the other weft thread end is improperly positioned and e.g. can bleed through.

SUMMARY OF THE INVENTION

An object of the present invention is to make available a weaving machine including an apparatus for tucking in one or more weft thread ends and for forming a cloth edge as well as an apparatus and a method for tucking in one or more weft thread ends and for forming a cloth edge which reduce weaving errors as a result of improperly tucked in weft thread ends and which enable unobjectionable cloth edges to be produced even if stiffer yarns are used and/or if a plurality of weft thread ends are inserted into the same shed.

The weaving machine in accordance with the invention includes an apparatus for tucking in one or more weft thread ends and for forming a cloth edge, the apparatus including a mechanical, pneumatic or pneumo-mechanical selvedge tucker, which can be arranged within or outside the cloth width. Furthermore, a shed forming apparatus for forming a shed with a shed apex is provided on the weaving machine. In the weaving machine in accordance with the invention the apparatus for tucking in one or more weft thread ends includes at least one additional blowing nozzle which is arranged within the cloth width, and the jet direction of which is oriented towards the shed apex in order to be able to blow the weft thread ends into the shed apex. The additional blowing nozzle preferably includes a nozzle opening which is arranged within the shed.

The weaving machine preferably includes a weft insertion direction, and the jet direction of the additional blowing nozzle preferably extends substantially perpendicularly to the weft insertion direction. The weaving machine preferably includes relay nozzles and the additional blowing nozzle is preferably arranged in a row with the relay nozzles. In a preferred variant the jet direction of the additional blowing nozzle can be set. In a further preferred variant the additional blowing nozzle is arranged to be adjustable along the weft insertion direction and/or in height and/or in the warp direction.

The weaving machine preferably includes a sley with a beat up position and a severing device for cutting off inserted weft threads; and the weaving machine and/or the apparatus for tucking in one or more weft thread ends preferably includes a control system which switches on the additional blowing nozzle after the severing of the inserted weft threads, preferably during or after the tucking in of the weft thread ends. The control system preferably switches off the additional blowing nozzle before the sley reaches the beat up position.

Furthermore, the invention includes an apparatus for tucking in one or more weft thread ends and for forming a cloth edge in a weaving machine with a shed and a shed tip, the apparatus having a mechanical, pneumatic or pneumo-mechanical selvedge tucker as well as at least one additional blowing nozzle which is designed in such a manner that the jet direction of the additional blowing nozzle can be oriented in the direction towards the shed apex and the additional blowing nozzle can be used within the cloth width, in particular within the width of the cloth edge. The additional blowing nozzle is preferably designed so that a nozzle opening of the latter can be used within the shed, in particular so that a nozzle opening can be used within the shed without causing a weaving error in the cloth to be formed.

In a preferred variant the jet direction of the additional blowing nozzle can be set. In a further preferred variant the additional blowing nozzle is designed to be elongate and to be provided with a mounting which is designed so that the additional blowing nozzle is adjustable in the direction of the lateral extent and/or in a direction perpendicular to the lateral extent and to the jet direction.

The invention furthermore includes a method for tucking in one or more weft thread ends and for forming a cloth edge in a weaving machine, with a shed with a shed apex being formed on the weaving machine and with the weft thread ends being tucked into the shed in the method by means of a mechanical, pneumatic or pneumo-mechanical selvedge tucker. In addition the weft thread ends are blown into the shed apex by means of at least one additional blowing nozzle, which is arranged within the width of the cloth, in particular within the width of the cloth edge, and the jet direction of which is oriented towards the shed apex. The weft thread ends are preferably held firmly in the shed apex by the additional blowing nozzle. The additional blowing nozzle preferably includes a nozzle opening which is arranged within the shed, in particular in such a manner that no weaving errors are produced by the additional blowing nozzle.

In a preferred embodiment the weft threads are inserted, beaten up and severed and the additional blowing nozzle is switched on after the severing of the inserted and beaten up weft threads, preferably during or after the tucking in of the weft thread ends. The additional blowing nozzle is preferably switched off before the beating up of the weft threads which are subsequently inserted has been completed.

The weaving machine in accordance with the invention and the apparatus and the method for tucking in one or more weft thread ends in accordance with the present invention have the advantage that the weft thread ends are blown through the at least one additional blowing nozzle towards the shed apex particularly effectively and can be smoothed and held firmly there. The arrangement of the additional blowing nozzle within the cloth width enables an ideal jet direction for the smoothing and the firm holding of the weft thread ends and a shorter distance to the thread end, which can thereby be better held under control. Due to the improved control of the thread end the so-called bleeding through of the thread ends can be largely avoided. In this way weaving errors as a result of improperly tucked in weft thread ends can be effectively reduced. The weaving machine as well as the apparatus and the method in accordance with the present invention enable an unobjectionable cloth edge to be produced even in difficult cases in which stiffer yarns are used or a plurality of weft thread ends are inserted into the same shed.

The invention will be explained in the following in more detail with reference to exemplary embodiments and with reference to the drawings.

DESCRIPTION OF THE PREFERRED EMBODIMENTS

Figure 1:
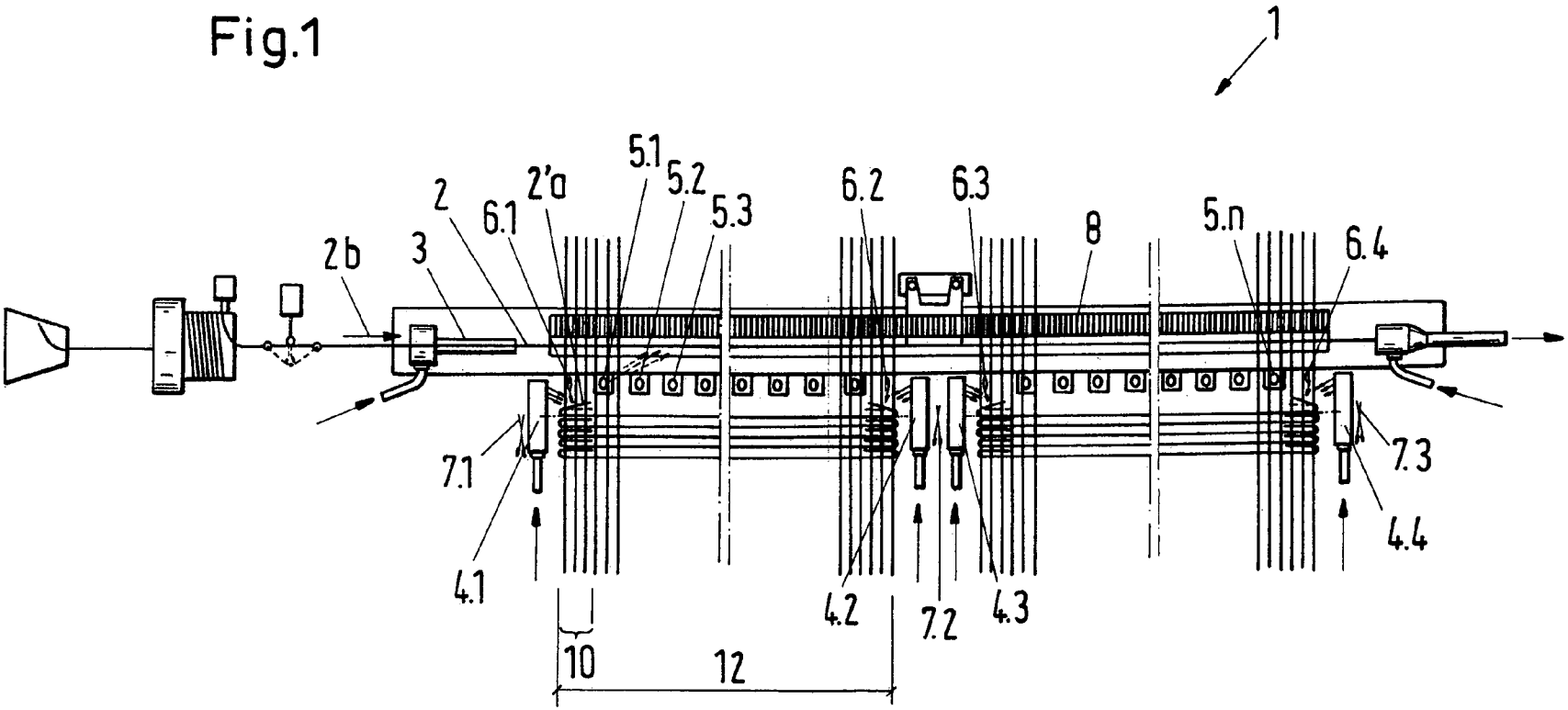
FIG. 1 shows an exemplary embodiment of a weaving machine with an apparatus for tucking in one or more weft thread ends in accordance with the present invention.

FIG. 1 shows an exemplary embodiment of a weaving machine with an apparatus for tucking in one or more weft thread ends 2'*a* and for forming a cloth edge in accordance with the present invention. The weaving machine 1 is designed as an air jet weaving machine in this exemplary embodiment. It is however also possible to use the apparatus for tucking in one or more weft thread ends and for forming a cloth edge which is described in the following in combination with other kinds of weaving machines, for example with rapier weaving machines or with projectile weaving machines. In this exemplary embodiment the apparatus for tucking in one or more weft thread ends 2'*a* and for forming a cloth edge 10 includes one or more nozzles 4.1–4.1, which are formed as air tuckers and which are arranged outside the cloth width 12. Mechanical tuckers or pneumo-mechanical tuckers, the nozzles of which are arranged outside the cloth width, can also be used instead of the air tuckers. Furthermore, a shed forming apparatus for the formation of a shed with a shed apex, which is not shown in FIG. 1, is provided on the weaving machine 1.

In the variant which is shown in FIG. 1 the weaving machine 1 includes a main nozzle 3 and a plurality of relay nozzles 5.1–5.*n* for the insertion of a weft thread 2, a sley 8 with a reed, and one parting device 7.1, 7.3 at each of the weft insertion side and the weft arrival side in order to cut the weft thread 2 which is inserted by means of the main nozzle and the relay nozzles and which is beaten up by means of the reed, as well as an additional parting device 7.2 in order to sever the inserted and beaten up weft thread 2 in the middle. In this way two cloths can be manufactured next to one another at the same time. Each of the two cloths has a cloth width 12 and laterally one cloth edge 10 at each side, which is formed through tucking in of the weft thread ends 2'*a*. For forming the four cloth edges the weaving machine 1 in this variant includes one apparatus arranged in the region of each of the cloth edges for tucking in one or more weft thread ends. The parting device 7.2 and the two apparatuses for tucking in one or more weft thread ends in the middle can also be omitted in order e.g. to manufacture a cloth with a greater cloth width.

Figure 3:
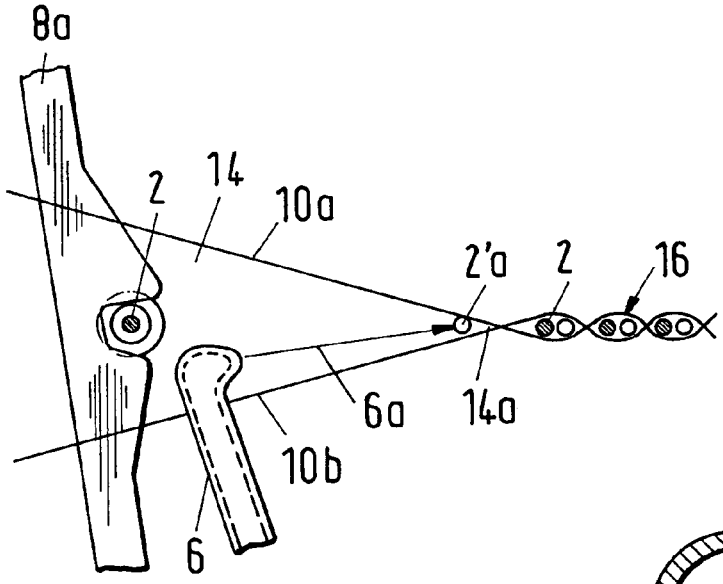
FIG. 3 is a detail view of a shed from the exemplary embodiment which is shown in FIG. 1.

In the exemplary embodiment the apparatuses for tucking in one or more weft thread ends 2'*a* each include at least one additional blowing nozzle 6.1–6.4. The additional blowing nozzles are preferably arranged within the width of the respective cloth edge 10, with their jet directions oriented towards the apex of a shed which is formed by means of the shed forming apparatus in order to be able to blow the respective weft thread ends 2'*a* into the shed apex 14*a*. In a preferred embodiment the additional blowing nozzles 6.1–6.4 include nozzle openings which are arranged within the shed 14. A corresponding arrangement of an additional blowing nozzle is illustrated in FIG. 3, which will be explained in more detail in a following section.

Figure 2:
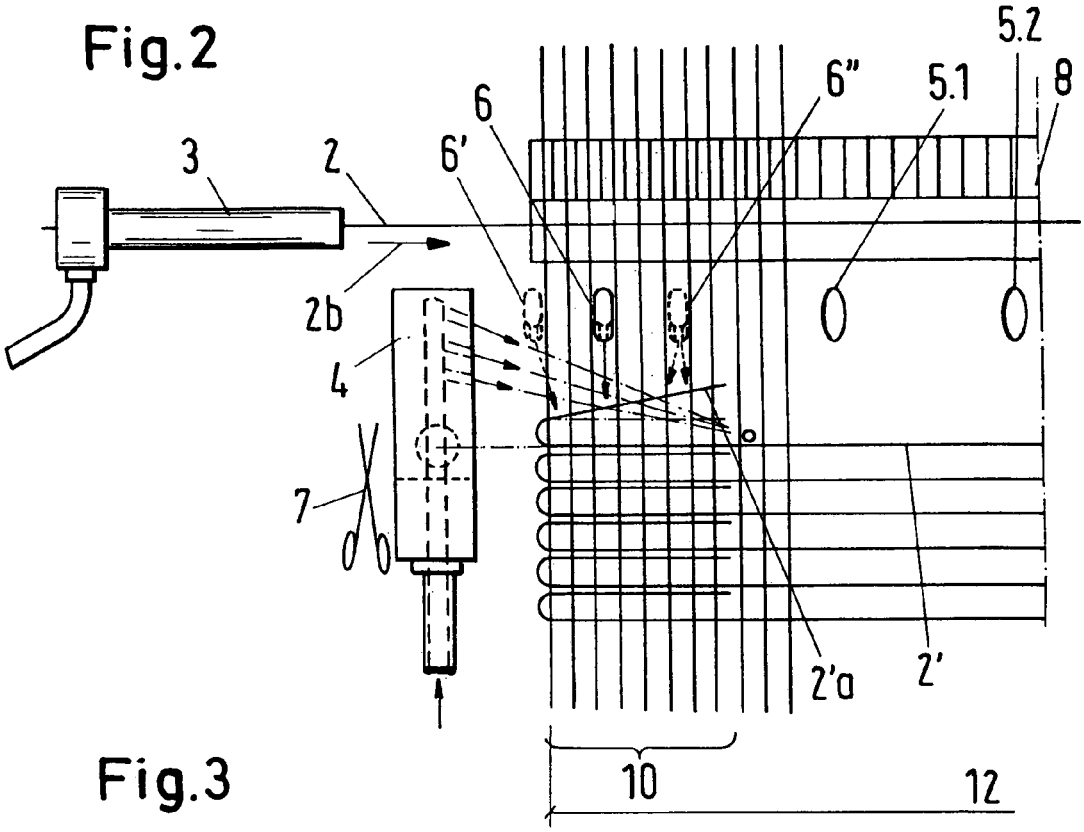
FIG. 2 is a detail view of one apparatus for tucking in one or more weft thread ends, taken from the exemplary embodiment which is shown in FIG. 1.

FIG. 2 shows a detail view of one apparatus for tucking in one or more weft thread ends 2'*a*, taken from the exemplary embodiment shown in FIG. 1. In this exemplary embodiment the apparatus includes an air tucker 4 and an additional blowing nozzle 6 which is arranged within the cloth width 12, preferably within the width of the cloth edge 10, and the jet direction of which is oriented towards the apex of a shed which is formed by means of a shed forming apparatus in order to be able to blow the weft thread end 2'*a* into the shed apex. The additional blowing nozzle 6 is advantageously arranged on a sley 8 of the weaving machine. In a preferred embodiment the additional blowing nozzle 6 includes a nozzle opening which is arranged within the shed.

In the exemplary embodiment the weaving machine has a weft insertion direction 2*b*, and the additional blowing nozzle 6 is preferably oriented in such a manner that the jet direction of the additional blowing nozzle extends substantially perpendicular to the weft insertion direction 2*b*. In the variant which is shown in FIGS. 1 and 2 the weaving machine includes relay nozzles 5.1–5.*n* and a sley 8, and the additional blowing nozzle 6 is advantageously arranged on the sley 8 together with the relay nozzles 5.1–**5.*n*. The additional blowing nozzle 6 is preferably arranged in a row with the relay nozzles 5.1–5.*n***, for example in that the additional blowing nozzle and the relay nozzles are secured to a common mounting rail.

In a preferred variant the apparatus for tucking in one or more weft thread ends can include further additional blowing nozzles 6', 6" in addition to the above-named additional blowing nozzle 6 in order to increase the reliability to ensure problem-free tucking in of the weft thread ends. The additional blowing nozzles 6, 6', 6" are advantageously arranged on a sley 8 of the weaving machine. In FIG. 2 for example one further additional blowing nozzle 6', 6", which is drawn in in FIG. 6 in dotted lines, is provided at each side of the above-named additional blowing nozzle 6. The further additional blowing nozzle 6", which is drawn in on the left in FIG. 2, can be arranged within or outside the cloth width 12.

FIG. 3 shows a detail view of a shed from the exemplary embodiment which is shown in FIG. 1. The shed 14 is formed by the upper and lower warp threads **10*a*, 10*b*, which run together in the cloth draw off direction in the shed apex 14*a*, with the shed 14 together with a reed, of which a reed lamella 8*a* is drawn in in FIG. 3, forming a shed triangle. The reed lamella 8*a* includes a weft insertion passage for guiding a weft thread 2 during the insertion. Arranged after the shed triangle in the cloth draw off direction are the weft threads which have already been bound in and which form a cloth 16. At the illustrated point in time the shed apex 14*a* contains the weft thread end 2'*a* of the weft thread 2' which was beaten up last. Of the apparatus for tucking in one or more weft thread ends 2'*a* of the above-described exemplary embodiment only the additional blowing nozzle 6 is drawn in, the nozzle opening of which is arranged within the shed 14, and the main jet direction 6*a* of which is oriented in the direction towards the shed apex 14*a***.

Figure 4:
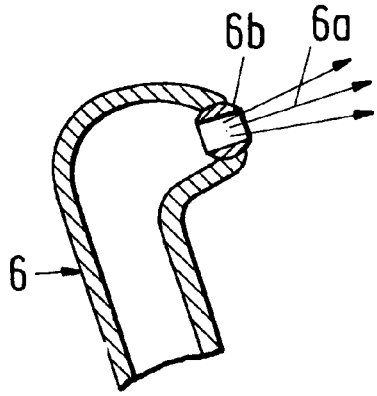
FIG. 4 shows a variant of an additional blowing nozzle seen in cross-section.

FIG. 4 shows a variant of an additional blowing nozzle in cross-section. The additional blowing nozzle 6 preferably has a jet direction **6*a* which can be set, for example in that a spherically shaped insert 6*b* with a nozzle opening is provided in the additional blowing nozzle 6 in order to be able to set the jet direction 6*a*. Instead of or in addition to the ability to set the jet direction, the additional blowing nozzle 6 can include a mounting apparatus by means of which the additional blowing nozzle 6** is adjustable along the weft insertion direction and/or in height and/or in the warp direction. The adjustability of the jet direction and the adjustability of the additional blowing nozzle in one or more directions enables in an advantageous manner the nozzle jet of the additional blowing nozzle to be adapted to various tasks, for example to different cloth and edge widths and/or to different yarns and/or to the insertion of a plurality of weft thread ends into the same shed.

In a preferred embodiment the additional blowing nozzle 6 includes a nozzle opening which is arranged within a shed 14 in order to be able to blow the weft thread ends **2'*a* directly and with ideal jet direction into the shed apex 14*a*. In this variant the additional blowing nozzle 6 is designed in such a manner that the mounting of the additional blowing nozzle is normally arranged outside and that that part of the blowing nozzle which contains the nozzle opening can pass without difficulty between the warp threads, i.e. from below or above, into the shed. A corresponding design of the additional blowing nozzle 6 is indispensable in this variant since otherwise during the change of shed, or when the additional blowing nozzle is mounted on a sley and when during the beating up of the weft threads the nozzle opening comes to lie outside the shed and then enters into the shed again, the warp threads can be displaced or damaged, which can lead to disturbing weaving errors or cloth faults. The additional blowing nozzle 6 preferably has an elongate form and a narrow cross-section. Correspondingly formed nozzles are for example known from air jet weaving machines and are designated there as relay nozzles. In contrast to the relay nozzles, the jet direction of which points firmly in the weft insertion direction, the additional blowing nozzle 6** is designed in such a manner that its jet direction is oriented toward the shed apex.

The additional blowing nozzle which is described under FIG. 4 and/or the above-described preferred embodiment of an additional blowing nozzle can also be considered as subjects which are independent of the present application and can be protected in one or more separate patent applications. The same also holds for an apparatus for tucking in one or more weft thread ends or a weaving machine with an additional blowing nozzle of this kind or for the use of an additional blowing nozzle of this kind in an apparatus for tucking in one or more weft thread ends in a weaving machine.

An exemplary embodiment of a method for the tucking in of one or more weft thread ends and for forming a cloth edge in a weaving machine in accordance with the present invention will be described below with reference to FIGS. 2 and 3. In the method in accordance with the exemplary embodiment a shed 14 with a shed apex **14*a* is formed on the weaving machine and the weft thread ends 2'*a* are tucked into the shed 14 by means of a mechanical tucker and/or a nozzle arrangement 4 which is arranged outside the cloth width 12 and which can for example be designed as an air tucker. In addition the weft thread ends 2'*a* are blown into the shed apex by means of an additional blowing nozzle 6 which is arranged within the cloth width 12, in particular within the width of the cloth edge 10, and the jet direction 6*a* of which is oriented toward the shed apex 14*a*. The weft thread ends 2'*a* are preferably held firmly in the shed apex by the additional blowing nozzle 6. The additional blowing nozzle 6 preferably includes a nozzle opening which is arranged within the shed 14, in particular in such a manner that no cloth faults are produced by the additional blowing nozzle 6**.

In an advantageous variant the method in accordance with the exemplary embodiment also includes the control of the additional blowing nozzle 6. The additional blowing nozzle 6 is switched on after the severing of an inserted and beaten up weft thread 2' and in particular during or after the tucking in of the associated weft thread end **2'*a*. The switching off of the additional blowing nozzle 6 preferably takes place before the completion of the beating up of the weft thread end 2'*a* together with a subsequently inserted weft thread 2, i.e. when a sley 8 with a beat up position is used for the beating up, before the sley 8** has reached the beat up position.

The above enumeration of variants of the weaving machine in accordance with the invention and of the apparatus and of the method for tucking in of one or more weft thread ends and for the formation of a cloth edge in accordance with the present invention is by no means exhaustive. Through corresponding modifications of the exemplary embodiment which is shown in the figures, further variants can be derived which have all the advantages of the weaving machine in accordance with the invention and the apparatus and the method in accordance with the invention and which have in particular the advantage that the weft thread ends can be blown towards the shed apex with an ideal jet direction and can be smoothed and held firmly there.

The invention claimed is:

1. Weaving machine having an apparatus for tucking in one or more weft thread ends and for forming a cloth edge, said apparatus including a mechanical, pneumatic or pneumo-mechanical selvedge tucker, and a shed forming apparatus for forming a weaving shed with a shed apex at a fell of the cloth, the apparatus for tucking in one or more weft thread ends including at least one additional blowing nozzle arranged within the cloth width, and having a nozzle opening which is arranged within the shed and a jet direction oriented towards the shed apex in order to blow the weft thread ends into the shed apex.

2. Weaving machine in accordance with claim 1, with the weaving machine including a weft insertion direction and with the jet direction of the additional blowing nozzle extending substantially perpendicularly to the weft insertion direction, and/or with the weaving machine including relay nozzles and the additional blowing nozzle being arranged in a row with the relay nozzles.

3. Weaving machine in accordance with claim 1, with the jet direction of the additional blowing nozzle being settable, and/or with the additional blowing nozzle being adjustably arranged along the weft insertion direction and/or in height and/or in the warp direction.

4. Weaving machine in accordance with claim 1, with the weaving machine including a sley with a beat up position and one or more severing devices for parting inserted weft threads, and a control system in order to switch on the additional blowing nozzle after the parting of the inserted weft thread, in particular during or after the tucking in of the weft thread ends and/or in order to switch off the additional blowing nozzle, in particular before the sley reaches the beat up position.

5. Apparatus for tucking in one or more weft thread ends and for forming a cloth edge in a weaving machine having a shed and a shed apex at a fell of the cloth, said apparatus including a mechanical, pneumatic or pneumo-mechanical selvedge tucker, wherein the apparatus for tucking in one or more weft thread ends includes at least one additional blowing nozzle having an oval form which has a longitudinal axis as viewed from above and a jet direction substantially in the direction of the longitudinal axis in order to orient a jet from the blowing nozzle in a direction towards the shed apex and in order to use the additional blowing nozzle within a cloth width.

6. Apparatus in accordance with claim 5, with the additional blowing nozzle being designed in such a manner that a nozzle opening of the latter can be used within the shed, in particular in such a manner that a nozzle opening of same can be used within the shed without causing weaving errors in a cloth to be formed.

7. Apparatus in accordance with claim 5, with the jet direction of the additional blowing nozzle being settable, and/or with the additional blowing nozzle being elongate and having a mounting such that the additional blowing nozzle is adjustable in the direction of the lateral extent and/or in a direction perpendicular to the lateral extent and to the jet direction.

8. Method for tucking in one or more weft thread ends and for forming a cloth edge in a weaving machine, with a shed with a shed apex being formed on the weaving machine, and with the weft thread ends being tucked into the shed by means of a mechanical, pneumatic or pneumo-mechanical selvedge tucker, comprising blowing the weft thread ends into the shed apex by means of at least one additional blowing nozzle and arranging the at least one additional blowing nozzle inside the shed and within the cloth width, the at least one additional blowing nozzle having a jet direction towards the shed apex.

9. Method in accordance with claim 8, with the additional blowing nozzle including a nozzle opening which is arranged within the shed in such a manner that no cloth faults are caused by the additional blowing nozzle.

10. Method in accordance with claim 8, with weft threads being inserted, beaten up and severed and with the additional blowing nozzle being switched on after the parting of the inserted and beaten up weft threads, and with the additional blowing nozzle being switched off before or at the point in time at which the beating up of the weft threads has been completed.

11. Weaving machine according to claim 1, wherein the at least one additional blowing nozzle is arranged within a width of the cloth edge.

12. Apparatus according to claim 5, wherein the at least one additional blowing nozzle is arranged within a width of the cloth edge.

13. Apparatus according to claim 5, wherein the at least one additional nozzle has a nozzle opening arranged within the shed.

14. Method according to claim 10, wherein the additional blowing nozzle is switched on during or after tucking in of the weft thread ends.

15. Weaving machine for weaving cloth with weft threads and warp threads and having a cloth width and a cloth edge comprising a shed forming apparatus for generating a weaving shed with the warp threads during weaving, the shed defining a shed apex, a tucker for tucking in at least one weft thread end, and a blowing nozzle arranged within the cloth width and positioned inside the shed for blowing the at least one weft thread into the shed apex with a fluid jet emitted by the nozzle and directed toward the shed apex, the nozzle being configured for movement past adjacent warp threads in and out of the shed.

16. Apparatus for tucking in one or more weft thread ends and for forming a cloth edge in a weaving machine that during weaving repeatedly generates a shed with a multiplicity of warp threads, the shed defining a shed apex, said apparatus including a mechanical, pneumatic or pneumo-mechanical selvedge tucker for tucking in one or more weft thread ends and at least one additional blowing nozzle for placement within a cloth width and inside the shed having an elongate form and a relatively narrow cross-section adapted to pass between adjacent warp threads without causing damage to the warp threads when the at least one additional blowing nozzle is moved in or out of the shed, the at least one additional blowing nozzle blowing in a direction towards the shed apex.

17. Apparatus in accordance with claim 16, with the additional blowing nozzle having a nozzle opening for placement within the shed without causing weaving errors in a cloth to be formed.

18. Apparatus in accordance with claim 16 with the blowing direction of the additional blowing nozzle being settable, and/or with the additional blowing nozzle being elongate and having a mounting such that the additional blowing nozzle is adjustable in the direction of a lateral extent and/or in a direction perpendicular to the lateral extent and to the blowing direction.

* * * * *